US005438853A

United States Patent [19]

Bartsch

[11] Patent Number: 5,438,853

[45] Date of Patent: Aug. 8, 1995

[54] LUGGAGE CATCH

[75] Inventor: Georg Bartsch, Iserlohn, Germany

[73] Assignee: Sudhaus Schloss und Beschlagetechnik GmbH & Co., Iserlohn, Germany

[21] Appl. No.: 129,411

[22] Filed: Sep. 30, 1993

[30] Foreign Application Priority Data

Oct. 1, 1992 [DE] Germany ..... 9213230 U

[51] Int. Cl.[6] ..... F05B 65/52; A45C 13/12

[52] U.S. Cl. ..... 70/69; 70/DIG. 32; 292/DIG. 48; 292/DIG. 55; 292/242

[58] Field of Search ..... 70/64–72, 70/74, DIG. 32, 7, 11, 12; 292/DIG. 38, DIG. 39, DIG. 40, DIG. 42, DIG. 48, DIG. 51, DIG. 55, 242, 207, 80, 88, 283; 190/120, 121; 24/625, 611, 607

[56] References Cited

U.S. PATENT DOCUMENTS

| | | | |
|---|---|---|---|
| 845,781 | 3/1907 | Hawley | 292/283 |
| 955,856 | 4/1910 | Dittmar | 70/71 |
| 1,947,524 | 2/1934 | Horlot | 292/DIG. 39 |
| 2,565,862 | 8/1951 | Levive | 292/207 |
| 2,819,604 | 1/1958 | Levine | 70/13 |
| 3,100,980 | 8/1963 | Humphries | 70/71 |
| 4,712,280 | 12/1987 | Filoan | 24/625 |

FOREIGN PATENT DOCUMENTS

| | | | |
|---|---|---|---|
| 949265 | 7/1947 | France | 70/67 |
| 1456389 | 9/1966 | France | 70/7 |
| 1428506 | 11/1964 | Germany | 70/69 |
| 1926116 | 6/1965 | Germany . | |
| 1553467 | 9/1970 | Germany | 70/69 |
| 2057807 | 1/1972 | Germany | 70/69 |
| 7437524 | 10/1974 | Germany . | |
| 418541 | 2/1967 | Switzerland | 70/7 |
| 1235044 | 6/1971 | United Kingdom | 70/12 |
| 2133830 | 8/1984 | United Kingdom | 70/69 |

*Primary Examiner*—Peter M. Cuomo
*Assistant Examiner*—Darnell M. Boucher
*Attorney, Agent, or Firm*—Herbert Dubno; Andrew Wilford

[57] ABSTRACT

A luggage catch has a catch part having an edge, a tongue pivotally mounted on the catch part, extending downward past the edge thereof, and having a pair of oppositely outwardly directed sides, and a strike part having an edge and formed with a seat opening at the strike-part edge and having a pair of oppositely inwardly directed sides generally complementary to and fittable with the sides of the tongue below the catch-part edge in a closed position of the catch with the edges engaging each other. Retaining formations in the strike part and on the tongue engage each other in the closed position of the catch for holding the tongue in place in the seat. The tongue extends a relatively great distance from the catch part so that, even when it has a middle region at the catch-part edge and an outer end outward of the catch-part edge and tapers from the middle region to the outer end and the seat tapers generally complementarily away from the strike-part edge, it is possible for the lateral engagement of the tongue sides with the seat sides to correct a relatively gross misalignment of the two parts.

18 Claims, 3 Drawing Sheets

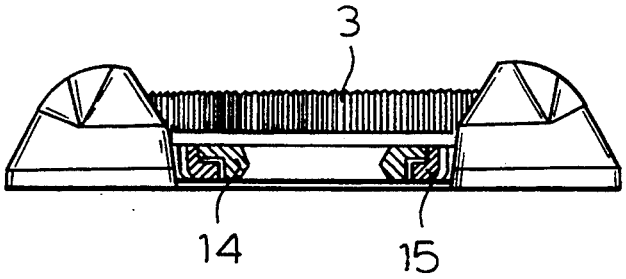
FIG.10
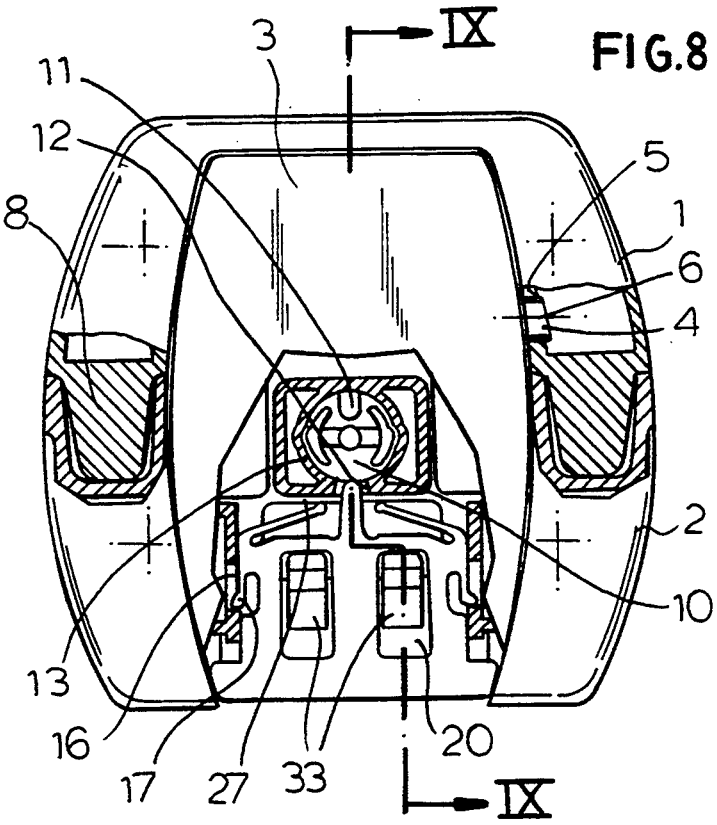
FIG.8
FIG.9
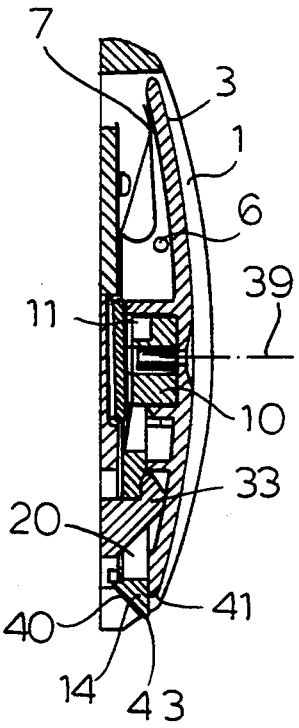
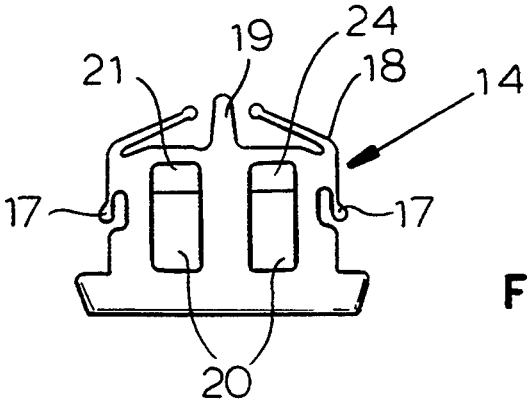
FIG.11

LUGGAGE CATCH

FIELD OF THE INVENTION

The present invention relates to a catch. More particularly this invention concerns such a catch as is used on a piece of luggage, handbag, trunk, or the like.

BACKGROUND OF THE INVENTION

A standard clasp-type catch for a suitcase, handbag, trunk, or the like—typically called a luggage catch—has a catch part from which extends a tongue that can be retained in a strike part. Normally the catch part is provided on the part of the piece of luggage that is above the part that carries the strike part, but of course the orientation could be reversed or the two could move horizontally together. Such a catch is closed by pushing the two parts together and clicking the tongue into retaining formations on the strike part.

In many situations, in particular when the piece of luggage, handbag, or the like is made of nonrigid materials, the two catch parts can get seriously misaligned with each other. Thus when pushed together the tongue will not necessary fit properly with the retaining formations on the strike part.

To assist in alignment one of the parts is typically provided with teeth that taper toward the other part and that fit into complementarily tapering seats or sockets on the other part. Thus as the two parts are moved together and, so long as the displacement is not considerable, the teeth fit into the sockets and force the two parts into lateral alignment as the teeth seat fully.

This system works fairly well for modest displacement, but not for large ones. It is impractical to provide alignment teeth of adequate size to compensate for really large lateral misalignments between the two parts.

OBJECTS OF THE INVENTION

It is therefore an object of the present invention to provide an improved luggage catch.

Another object is the provision of such an improved luggage catch which overcomes the above-given disadvantages, that is which can compensate for relatively large misalignments between the two parts it is provided on.

SUMMARY OF THE INVENTION

A luggage catch according to the invention has a catch part having an edge, a tongue pivotally mounted on the catch part, extending downward past the edge thereof, and having a pair of oppositely outwardly directed sides, and a strike part having an edge and formed with a seat opening at the strike-part edge and having a pair of oppositely inwardly directed sides generally complementary to and fittable with the sides of the tongue below the catch-part edge in a closed position of the catch with the edges engaging each other. Retaining formations in the strike part and on the tongue engage each other in the closed position of the catch for holding the tongue in place in the seat.

Thus the tongue itself serves for aligning the two parts of the catch of this invention. The tongue extends a relatively great distance from the catch part so that, even when according to the invention it has a middle region at the catch-part edge and an outer end outward of the catch-part edge and tapers from the middle region to the outer end and the seat tapers generally complementarily away from the strike-part edge, it is possible for the lateral engagement of the tongue sides with the seat sides to correct a relatively gross misalignment of the two parts. Both the tongue and seat taper continuously and smoothly and in fact the edges of the tongue are outwardly convex for a relatively gentle correction of misalignment.

Furthermore according to the invention the tongue is pivotal on the catch part between a latched position in which it is engageable in the closed position by the retaining formations and an unlatched position in which it is not engageable in the closed position by the retaining formations. The catch also has a spring braced between the catch part and the tongue and biasing the tongue into the latched position.

The retaining formations of the invention include a tooth formed in the seat on the strike part and having an inclined flank turned away from the catch part and an opposite flank and a tooth formed on the tongue and engageable on displacement of the tongue into the seat with the inclined flank to pivot out the tongue and with the opposite flank on fitting of the tongue fully into the seat to hold the tongue therein.

The catch further has teeth formed on the catch-part edge, projecting therefrom toward the strike part, and having edges tapering toward the strike part and seats formed on the strike part edge in which the teeth are snugly received in the closed position of the catch. These teeth are relatively short relative to the tongue and only serve for alignment in the final stages of fitting-together of the two parts, so that when a piece of luggage, pocketbook, or the like equipped with the latch is closed the entire stress of any lateral forces will not be assumed by the tongue, but will instead will be picked up by the alignment teeth too.

The tongue of this invention is provided with a slide carrying the respective formation and displaceable between a holding position engaging the strike-part formation and a releasing position out of engagement therewith. The strike-part formation includes a hook and the formation on the slide is an aperture through which the hook engages in the closed position. The tongue is pivotal on the catch part between a latched position in which it is engageable in the closed position by the retaining formations and an unlatched position in which it is not engageable in the closed position by the retaining formations. A spring braced between the catch part and the tongue biases the tongue into the latched position. This spring is a hairpin spring having one leg bearing on the catch part and another end bearing on the tongue.

In accordance with further features of the invention a lock is provided on the tongue for preventing movement of the tongue into the freeing position. This lock includes a cylinder pivotal about an axis and formed with a radially outwardly open pocket, and an extension on the slide engageable in the pocket in a predetermined angular position of the cylinder and in the freeing position of the slide. The tongue itself is provided with a pair of pivot pins and the catch part has respective gudgeon seats receiving the pins. In the closed position the tongue is recessed in the seat.

BRIEF DESCRIPTION OF THE DRAWINGS

The above and other objects, features, and advantages will become more readily apparent from the following description, reference being made to the accompanying drawing in which:

FIG. 8 is a front view partly broken away in the closed and locked position;

FIG. 9 is a section taken along line IX—IX of FIG. 8;

FIG. 10 is a partly broken-away bottom view of the catch; and

FIG. 11 is a front view of the release button of the catch.

SPECIFIC DESCRIPTION

Figure 6:
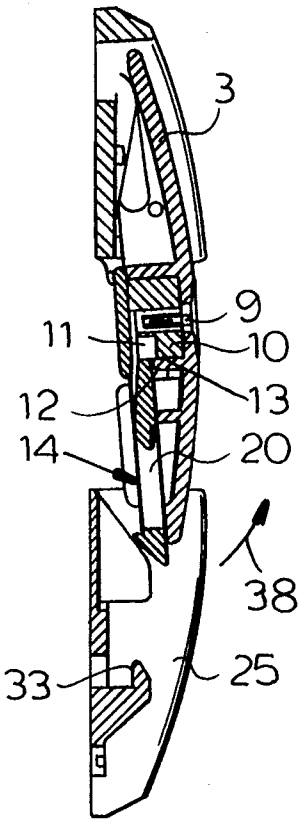
FIG. 6 is a section taken along the plane of line VI—VI of FIG. 3 of the catch in the partially closed and unlocked position.
Figure 5:
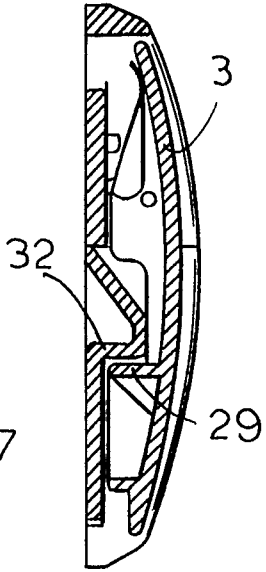
FIG. 5 is a section like FIG. 4 but with the catch in the fully closed position.
Figure 4:
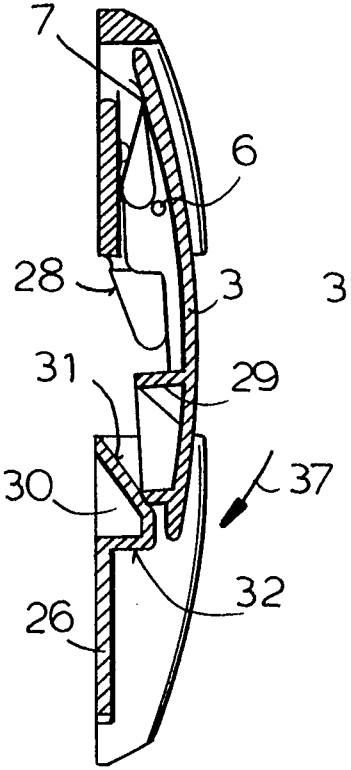
FIG. 4 is a section taken along the plane of line IV—IV of FIG. 3 of the catch in the partially closed position.
Figure 2:
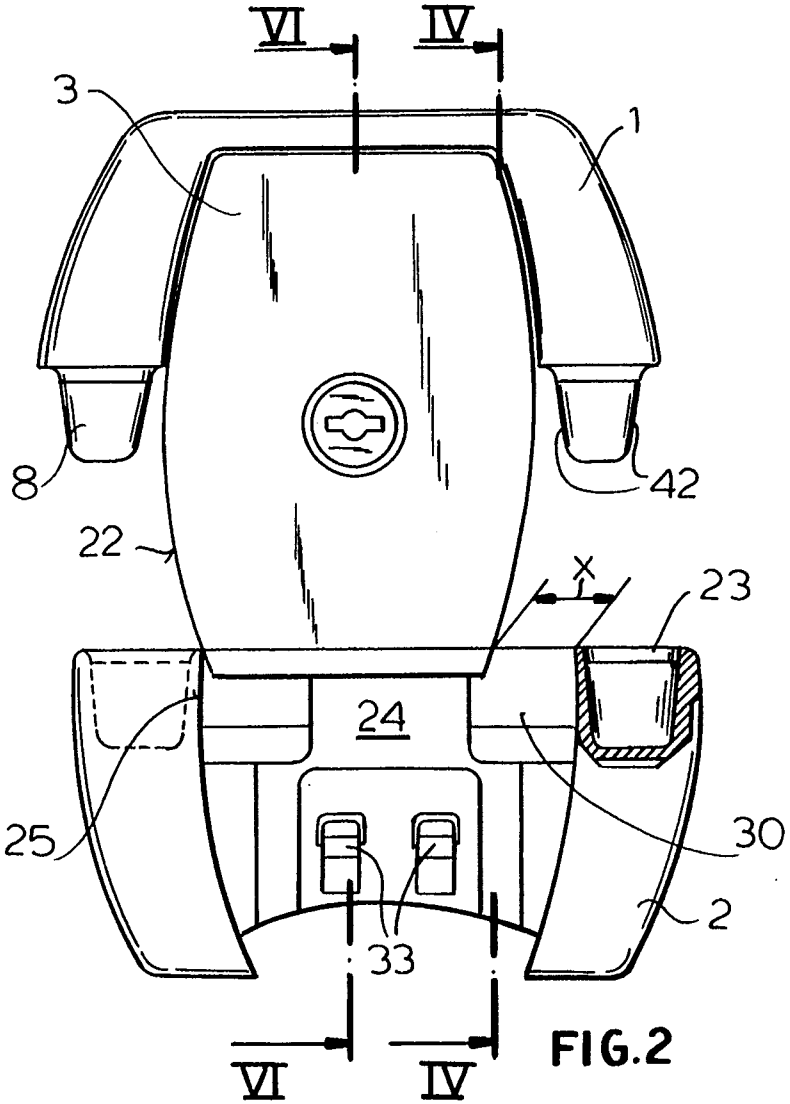

As seen in the drawing a catch according to this invention basically comprises a top catch part 1 normally secured to a suitcase lid (shown schematically at 34) or the like and a bottom strike part 2 normally secured to a suitcase base (shown schematically at 35) or the like. The top part 1 carries a catch tongue 3 having pins 4 received in gudgeon or pivot sockets 5 for pivoting of the element 3 about an axis 6 that here extends horizontally for pivoting of the catch tongue 3 inward in direction 37 (FIG. 4) and outward in direction 38 (FIG. 6) as will be described below. A spring 7 braced between the tongue 3 and the part 1 urges the tongue 3 pivotally in the direction 37. It is to be understood that the references to the vertical are purely for convenience of description since the catch would work equally well upside down or on its side or back.

The top part 1 is provided to each side of the catch tongue 3 with a tooth 8 that, seen from the front, is of downwardly tapering isosceles trapezoidal shape with angled side flanks 42 and, seen from the side, is of downwardly pointed isosceles triangle shape with angled front and back flanks 28. The bottom part 2 is formed with a pair of upwardly open pockets or seats 23 in which these teeth 8 are snugly receiveable when the two parts are in the closed positions of FIGS. 1, 5, 7, 8, and 9. The tongue 3 has a pair of outwardly convex curved sides 22 and the base part 2 is formed with a recess or seat 24 with curved sides 25 that are complementary to the sides 22 below where they extend past the lower edge of the top part 1 so that this tongue 3 can be received complementarily in the seat 24 when the teeth 8 are seated in the pockets 23, with the sides 22 fitting against the sides 25 below middle points of the sides 22.

The tongue 3 is provided centrally with a key hole 9 behind which is provided a key-rotatable lock cylinder 10 rotatable about an axis 39 in the tongue 3 and provided with a single radially open pocket 11. The tongue 3 is formed with a cylindrical guide 13 in which the cylinder 10 is rotatable and which is formed with a downwardly open aperture or hole 12 alignable with the pocket 11 in one angular position of the cylinder 10 corresponding to the unlocked position of the catch.

In addition the catch tongue 3 is provided with a vertically slidable release button 14 or slide engaged as seen in FIG. 10 in guides 15 that allow it to move longitudinally of the tongue 3. This button 14 is unitarily formed as seen also in FIG. 11 of a synthetic resin with a pair of laterally projecting but inwardly deflectable fingers 17 that can engage in apertures formed in the guides 15 and on its upper end with a pair of upwardly angled but downwardly elastically deflectable spring fingers 18 that bear against a bottom surface 27 of the tongue 3 to continuously urge the button 14 longitudinally downward in the tongue 3. Furthermore this button 14 is formed with an upwardly projecting extension 19 that can poke through the hole 12 into the recess 11 when same is aligned downwardly with this hole 12. Finally the button is formed with two longitudinally elongated and laterally adjacent throughgoing holes or apertures 20 having upper catch edges 21. A lower edge 43 of the button 14 is straight and the button 14 has an angled back surface 40. Normally the spring fingers 18 urge the button into a position projecting slightly past the lower edge 41 of the tongue 3 which itself is slightly above the lower edge of the base part 2 in the closed position.

The base part 2 in its turn is provided on a back wall of the seat 24 with a pair of upwardly directed integral hooks 33 that can engage through the holes 20 or formations as described below. In addition a pair of sawteeth 30 each having an inclined upper face 31 and a perpendicular lower face 32 are formed in this seat 24. They can each coact with a respective inwardly projecting tooth formation 29 formed on an inside face of the tongue 3 to either side of the tongue 3.

Figure 1:
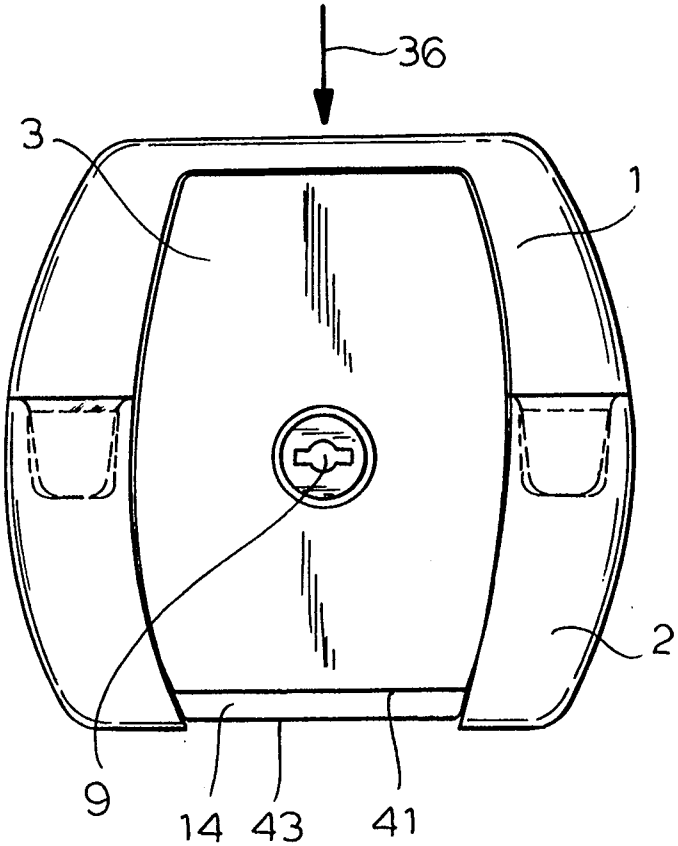
FIGS. 1 and 2 are front views of the catch in the closed and open position, respectively.

The catch described above functions as follows:

On closing, the top part i can be offset laterally from the base part 2 by as much as the distance x, which is determined by the difference between the width of the tongue 3 at its lowermost end and the width of the upper end or mouth of the seat 24. As it is pushed closed one of the sides 22 of the tongue 3 will, to start with, engage the respective side 25 of the seat 24, pushing the entire part 1 to the opposite side as they move together in closing direction 36 (FIG. 1). As the parts 1 and 2 approach, the angled sides 42 of the teeth 8 will similarly engage the sides of the pockets 23 while the angled front and back faces 28 will similarly engage the front and back edges of these pockets 23 to completely align the two parts 1 and 2.

Figure 7:
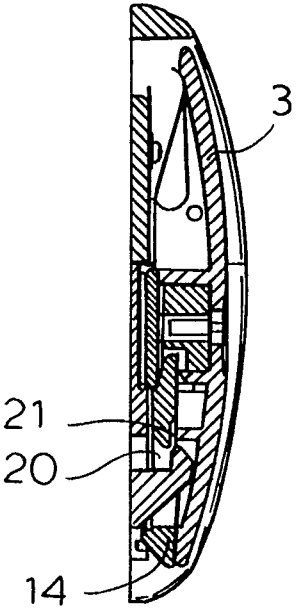
FIG. 7 is a view like FIG. 6 but with the catch in the fully closed and unlocked position.
Figure 3:
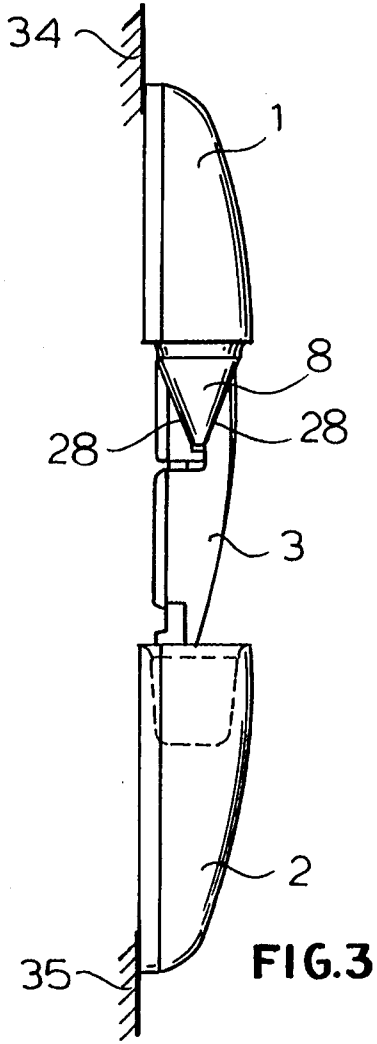
FIG. 3 is a side view of the catch in the open position.

Meanwhile the angled back edge 40 of the button 14 will strike and slide over the inclined flanks 31 of the teeth 30 and then the teeth 29 of the button 14 will do the same, pivoting out the tongue 3 against the force of its return spring 7 so the teeth 29 will pass down over and catch underneath the perpendicular flanks 32 of the teeth 30. At the same time the button 14, which has been pushed up by engagement of the surfaces 40 and 31, will fit with its holes or formations 20 over the hooks or formations 33 as seen in FIG. 7 and then slide down under the force of the springs 18 to the retaining position of FIG. 9, securing the catch in the closed position. This can only happen if the cylinder 10 is in the unlocked position; if it is not the tongue 3 will not catch.

If, once the catch is closed, the hole 11 of the cylinder 10 is not aligned with the projection 19, the button 14 cannot be pushed upward to free itself from the hooks 33, and the catch is locked. If it is thus aligned, it can be pushed up to release the hooks 33 and allow the catch to be opened.

Thus if the cylinder 10 permits it, the user exerts an upward push against direction 36 with a simultaneous outward component in direction 38 (FIG. 6) to pull the teeth 29 out from under the teeth 32 and allow the piece of luggage 34, 35 to be opened.

I claim:

1. A luggage catch comprising:

a catch part having an edge;

a tongue pivotally mounted on the catch part, extending past the edge thereof, and having a pair of oppositely outwardly directed sides;

a strike part having an edge and formed with a seat opening at the strike-part edge and having a pair of oppositely inwardly directed sides generally complementary to and fittable with the sides of the tongue below the catch-part edge in a closed position of the catch with the edges engaging each other;

a slide carried on the tongue; and means including a strike-part retaining formation in the strike part and a tongue-retaining formation on the slide of the tongue engageable with each other in the closed position of the catch for holding the tongue in place in the seat, the slide being displaceable between a holding position with the tongue-retaining formation engaging the strike-part formation and a releasing position out of engagement therewith.

2. The luggage catch defined in claim 1 wherein the tongue has a middle region at the catch-part edge and an outer end outward of the catch-part edge and tapers from the middle region to the outer end, the seat tapering generally complementarily away from the strike-part edge.

3. The luggage catch defined in claim 2 wherein both the tongue and seat taper continuously and smoothly.

4. The luggage catch defined in claim 2 wherein the edges of the tongue are outwardly convex.

5. The luggage catch defined in claim 1 wherein the tongue is pivotal on the catch part between a latched position in which it is engageable in the closed position by the strike-part retaining formation and an unlatched position in which it is not engageable in the closed position by the strike-part retaining formation, the catch further comprising a spring braced between the catch part and the tongue and biasing the tongue into the latched position.

6. The luggage catch defined in claim 5 wherein the retaining formations include a tooth formed in the seat on the strike part and having an inclined flank turned away from the catch part and an opposite flank, and a tooth formed on the tongue and engageable on displacement of the tongue into the seat with the inclined flank to pivot out the tongue and with the opposite flank on fitting of the tongue fully into the seat to hold the tongue therein.

7. The luggage catch defined in claim 1, further comprising teeth formed on the catch-part edge, projecting therefrom toward the strike part, and having edges tapering toward the strike part; and seats formed on the strike part edge in which the teeth are snugly received in the closed position of the catch.

8. The luggage catch defined in claim 1 wherein the strike-part formation includes a hook, the tongue-retaining formation being an aperture through which the hook engages in the closed position.

9. The luggage catch defined in claim 1 wherein the tongue is pivotal on the catch part between a latched position in which it is engageable in the closed position by the strike-part retaining formation and an unlatched position in which it is not engageable in the closed position by the strike-part retaining formation, the catch further comprising a spring braced between the catch part and the tongue and biasing the tongue into the latched position.

10. The luggage catch defined in claim 9 wherein the spring is a hairpin spring having one leg bearing on the catch part and another end bearing on the tongue.

11. The luggage catch defined in claim 1, further comprising lock means for preventing movement of the tongue into the freeing position.

12. The luggage catch defined in claim 11 wherein the lock means includes a cylinder pivotal about an axis and formed with a radially outwardly open pocket, and an extension on the slide engageable in the pocket in a predetermined angular position of the cylinder and in the freeing position of the slide.

13. The luggage catch defined in claim 1 wherein the tongue is provided with a pair of pivot pins and the catch part has respective gudgeon seats receiving the pins.

14. The luggage catch defined in claim 1 wherein in the closed position the tongue is recessed in the seat.

15. In combination with a piece of luggage having a top and a bottom, a catch comprising:

a catch part on the top having a lower edge;

a tongue pivotally mounted on the catch part for movement between outer and inner positions, extending downward past the lower edge, and having a pair of oppositely laterally outwardly directed and downwardly tapering sides;

a strike part having an upper edge and formed with a seat opening at the upper edge and having a pair of oppositely inwardly directed and downwardly tapering sides generally complementary to and fittable with the sides of the tongue below the lower edge in a closed position of the catch with the edges engaging each other;

a slide displaceable vertically and longitudinally on the tongue between a lower holding position and an upper freeing position; and means including a strike-part retaining formation in the strike part and a tongue retaining formation on the slide of the tongue engageable with each other in the closed position of the catch, the holding position of the slide, and the inner position of the tongue for holding the tongue in place in the seat.

16. The luggage catch defined in claim 15 wherein the parts are relatively movable in a predetermined closing direction for fitting of the tongue into the seat and the tongue is pivoted on the catch about an axis generally perpendicular to the closing direction and generally parallel to a plane of the tongue, the sides facing axially of the axis of the catch.

17. The luggage catch defined in claim 15, further comprising teeth formed on the lower edge, projecting therefrom toward the strike part, and having edges tapering toward the strike part, the tongue projecting past the lower edge substantially further than the teeth; and seats formed on the upper edge in which the teeth are snugly received in the closed position of the catch.

18. The luggage catch defined in claim 17 wherein the teeth flank the tongue.

* * * * *